United States Patent [19]

Purin

[11] Patent Number: 4,608,720

[45] Date of Patent: Sep. 2, 1986

[54] BOWLING GLOVE

[75] Inventor: Charles J. Purin, Rockford, Ill.

[73] Assignee: Rockford Sports Products, Inc., Rockford, Ill.

[21] Appl. No.: 777,935

[22] Filed: Sep. 19, 1985

[51] Int. Cl.[4] ..... A63B 69/00

[52] U.S. Cl. ..... 2/161 A; 273/54 B

[58] Field of Search ..... 273/54 B, 186; 2/161 A

[56] References Cited

U.S. PATENT DOCUMENTS

| | | | |
|---|---|---|---|
| 3,049,771 | 8/1962 | Meyer | 273/54 B |
| 3,224,012 | 12/1965 | Hamm | 273/54 B |
| 3,328,029 | 6/1967 | Paige | 273/54 B |
| 4,371,163 | 2/1983 | Shaffer et al. | 2/161 A |
| 4,441,711 | 4/1984 | Dunbar et al. | 2/161 A |
| 4,552,359 | 11/1985 | McDonald | 273/54 B |

*Primary Examiner*—Doris L. Troutman

*Attorney, Agent, or Firm*—Leydig, Voit & Mayer, Ltd.

[57] ABSTRACT

A bowling glove for improving the velocity and uniformity of a bowler's delivery includes a substantially rigid plate adapted to be strapped to the back side of the bowler's hand. A substantially rigid tongue projects upwardly from the plate and lies against the back of the wrist while a pair of laterally spaced and substantially rigid fingers project downwardly from the plate and lie against the backs of the index and little fingers. The plate, the tongue and the glove fingers coact to hold the bowler's wrist and index and little fingers in a substantially fixed position as the ball is delivered. The plate preferably is formed by two pivotally connected sections which enable the glove fingers to be adjusted laterally to fit hands of different widths.

20 Claims, 10 Drawing Figures

BOWLING GLOVE

BACKGROUND OF THE INVENTION

This invention relates to a glove for use by a bowler.

SUMMARY OF THE INVENTION

The general aim of the present invention is to provide a new and improved bowling glove which, when compared with prior gloves, enables the bowler to add more strength to the delivery, to place more power in the strike zone, and to impart a more nearly true roll to the ball.

A more detailed object of the invention is to achieve the foregoing by providing a unique glove which rigidly braces the wrist, the hand and the index and little fingers of the bowler to enable the bowler to maintain better control over the ball and to deliver the ball with higher velocity.

Another object is to provide a glove which may be easily adjusted to fit hands of virtually all sizes.

The invention also resides in the novel shape and construction of the glove and in the unique manner of releasably securing the glove to the hand.

These and other objects and advantages of the invention will become more apparent from the following detailed description when taken in conjunction with the accompanying drawings.

DETAILED DESCRIPTION OF THE PREFERRED EMBODIMENT

The present invention contemplates the provision of a new and improved glove 15 which enables a bowler to deliver the ball 16 with higher velocity and with better control. To achieve this, the glove rigidly braces the back of the bowler's wrist, the back of the hand 17 and the backs of the index and little fingers 18 and 19. As a result of such bracing, the flexibility inherent in the wrist, hand and index and little fingers is eliminated or substantially reduced so as to enable the bowler to maintain a more uniform delivery and to place more power into the delivery.

Figure 3:
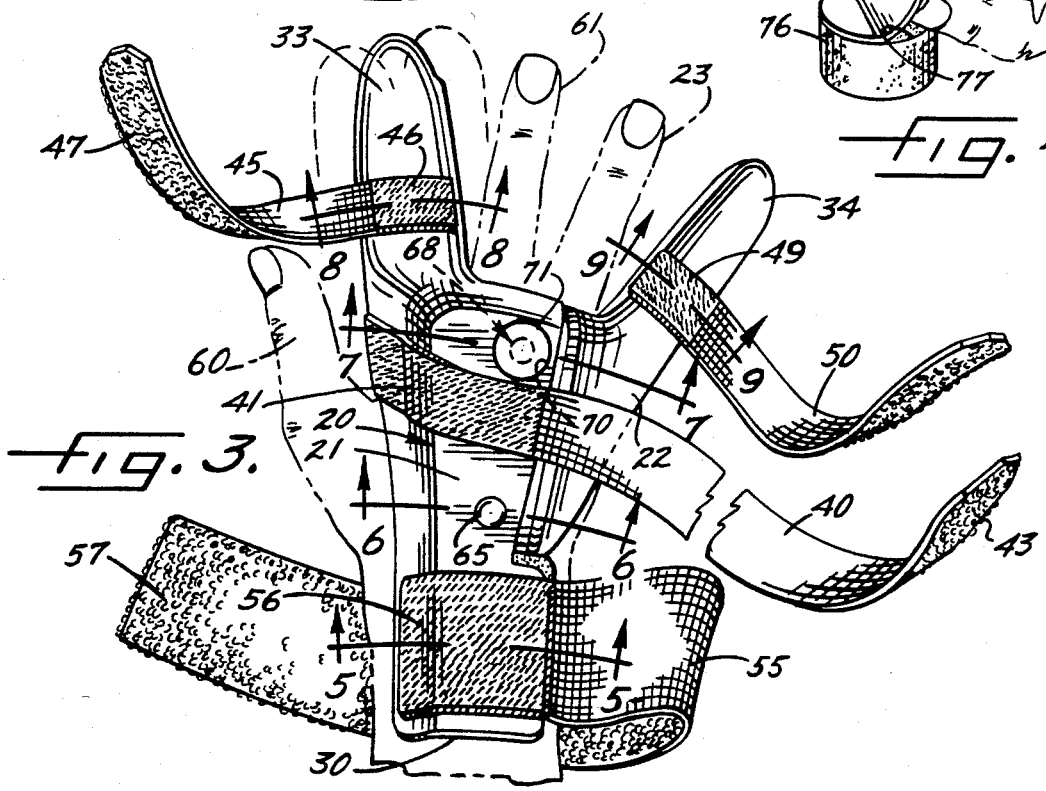
FIG. 3 is a rear elevational view of the glove but shows the straps released.
Figure 6:
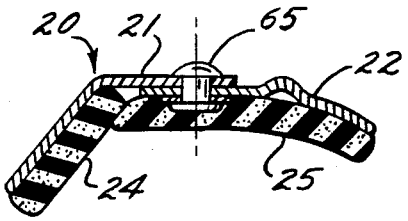
Figure 7:
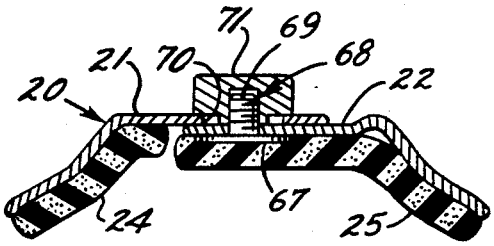

Specifically, the glove 15 comprises a plate-like member 20 made of substantially rigid but slightly flexible material such as high strength nylon plastic and adapted to overlie the back of the hand 17. In the preferred embodiment of the invention, the plate 20 is defined by two laterally adjustable and partially overlapping sections, namely, a rear plate section 21 and a forward plate section 22. The rear section 21 normally overlies that portion of the back of the hand extending approximately from the outboard side of the index finger 18 to the middle of the third finger 23 (see FIG. 3). The forward section 22 normally overlies the portion of the back of the hand extending approximately from the middle of the third finger 23 to the outboard side of the little finger 19, the forward section including an inboard side portion disposed beneath the adjacent side portion of the rear section (see FIGS. 1 and 3). Both plate sections are formed with angled or curved forward or inside surfaces which conform generally with the curvature of the back of the hand (see FIGS. 6 and 7). In addition, each section gradually becomes progressively wider upon progressing downwardly so as to conform generally to the increasing width of the hand (see FIGS. 1 and 3). In order to cushion the rigid plate 20 comfortably against the hand and to help the plate conform to the shape of the back of the hand, the forward or inside surfaces of the plate sections 21 and 22 are covered with pads 24 and 25, respectively, (FIGS. 6 and 7) made of soft elastomeric material such as foam rubber which may be bonded to the sections.

Figure 5:
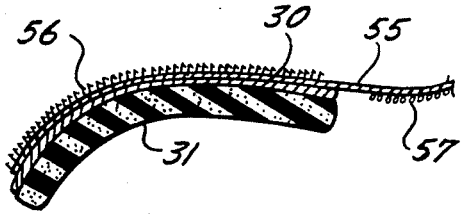
FIGS. 5, 6, 7, 8 and 9 are enlarged cross-sections taken substantially along the lines 5—5, 6—6, 7—7, 8—8 and 9—9, respectively, of FIG. 3.

In keeping with the invention, a substantially rigid tongue 30 (FIGS. 1 and 2) is formed integrally with and extends upwardly from the rear plate section 21 into overlying relation with the back of the wrist. The tongue extends upwardly beyond the wrist joint and coacts with the rear plate section to inhibit forward and rearward flexing of the wrist and to keep the wrist stiff. The forward or inside surface of the tongue is curved to conform generally to the curvature of the back of the wrist (see FIG. 5) and is cushioned by a pad 31 of foam rubber which is bonded to the tongue. The pad 31 preferably is formed integrally with the pad 24.

Figure 8:
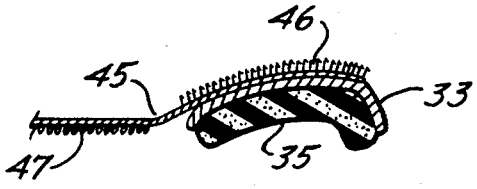
Figure 9:
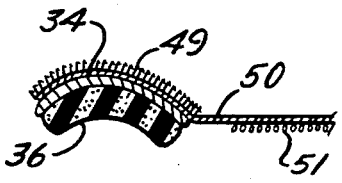
Figure 10:
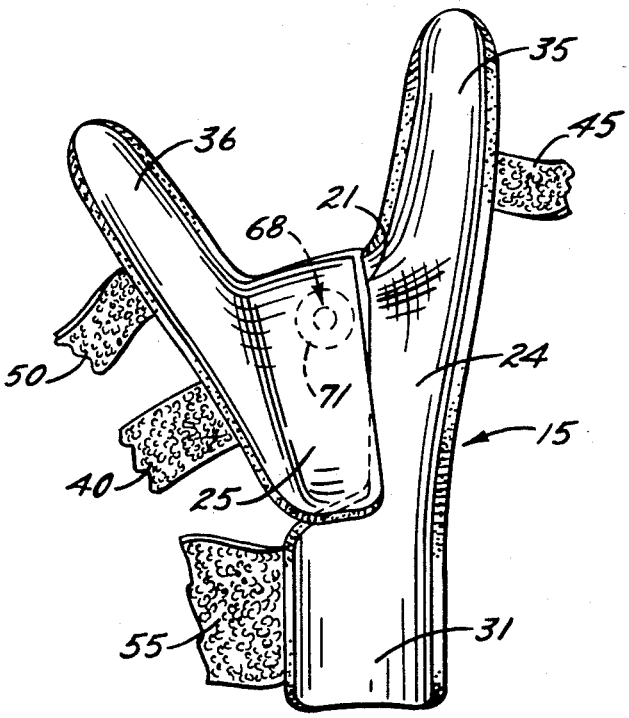
FIG. 10 is a front elevational view of the glove removed from the hand.

Further in keeping with the invention, elongated and substantially rigid fingers 33 and 34 (FIGS. 1 and 2) are formed integrally with and project downwardly from the plate 20 and are adapted to overlie the backs of the index finger 18 and little finger 19 of the bowler's hand 17 in order to keep those fingers stiff and rigid. Herein, the glove finger 33 is formed integrally with the rear plate section 21 and extends along the entire length of the back side of the index finger 18 and just slightly beyond the tip thereof. The glove finger 34 is spaced laterally from the finger 33 and is formed integrally with the forward plate section 22. The finger 33 extends along and just slightly beyond the back side of the bowler's little finger 19. Both glove fingers are curved to conform generally to the curvature of the back sides of their respective hand fingers (see FIGS. 8 and 9) but neither extends so far around the hand finger as to contact the bowling ball 16. Both glove fingers extend downwardly and forwardly from the plate 20 at an angle of about thirty degrees or so to enable the index and little fingers 18 and 19 to conform to the ball 16. Foam rubber pads 35 and 36 (FIGS. 8 and 9) are bonded to the forward surfaces of the glove fingers 33 and 34, respectively, to cushion the latter and to improve the conformance of the glove fingers to the hand fingers. The pad 35 preferably is formed integrally with the pads 24 and 31 while the pad 36 preferably is formed integrally with the pad 25 (see FIG. 10).

The glove 15 is adapted to be secured tightly but releasably to the hand 17. For this purpose, a first strap 40 (FIG. 3) has a Velcro hook-type end portion 41 bonded to the rear or outer side of the rear plate section 21 about midway along the length thereof. The strap extends across the forward plate section 22, is adapted to be wrapped around the palm of the hand and includes a Velcro loop-type end portion 43 adapted to tightly but releasably grip the complementary end portion 41.

A second strap 45 (FIG. 3) with a hook-type end portion 46 bonded to the rear surface of the finger 33 extends outwardly therefrom and is adapted to be wrapped around the bowler's index finger 18. A loop-type end portion 47 on the other end of the strap 45 is adapted to be fastened releasably to the end portion 46 to secure the glove finger 33 to the index finger 18.

Similarly, a hook-type end portion 49 of a strap 50 (FIG. 3) is bonded to the rear or outer surface of the glove finger 34 and extends outwardly therefrom. The strap 50 is adapted to be wrapped around the bowler's little finger 19 and secured in place by a loop-type portion 51 on the other end of the strap.

Finally, a strap 55 (FIG. 3) includes a hook-type end portion 56 bonded to the rear or outer surface of the tongue 30. After being wrapped around the wrist, the strap 55 may be secured in place by a loop-type end portion 57 on the other end of the strap and adapted to fasten the tongue 30 tightly to the wrist.

Figure 1:
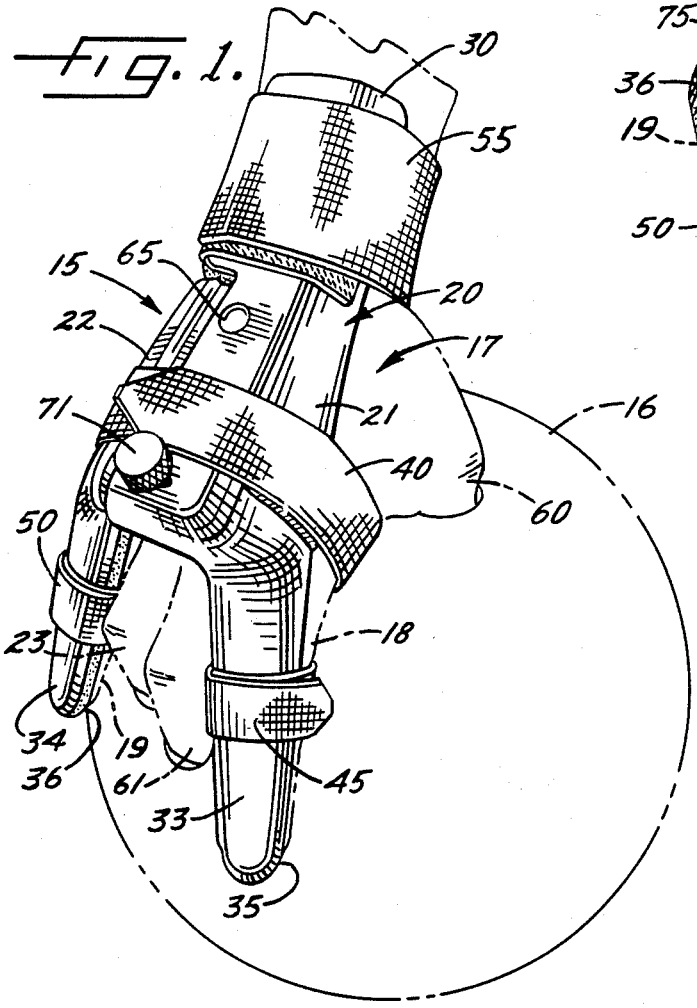
FIG. 1 is a perspective view of a new and improved bowling glove incorporating the unique features of the present invention.

With the foregoing arrangement, the glove 15 may be clamped tightly but releasably to the wrist, to the hand 17 around the palm thereof and to the index and little fingers 18 and 19. As a result, those hand parts are inhibited against flexing and are held in a substantially fixed position. The bowler's thumb 60, however, is not at all restricted by the glove and may be placed in the thumb hole of the ball 16 in normal fashion as shown in FIG. 1. In addition and because of the lateral separation of the glove fingers 33 and 34, the space between those fingers is open and thus the bowler may place his second and third fingers 61 and 23 between the glove fingers and into the finger holes of the ball without restriction (see FIG. 1). Thus, the bowler's thumb and second and third fingers grip, hold and lift the ball in a normal manner but, at the same time, the index and little fingers and the wrist are held stiff. It has been found that this arrangement not only enables the bowler to add more strength to the delivery and to place more power in the strike zone but also enables the bowler to establish a more nearly true roll and to maintain better uniformity from delivery-to-delivery.

The glove 15 preferably is adjustable and may be adapted to fit virtually all hand sizes. For this purpose, the two plate sections 21 and 22 are pivotally connected to one another by a pivot in the form of a rivet 65 (FIGS. 2 and 6) which extends through the plate sections near the upper ends thereof. By virtue of the pivot 65, the plate section 21 may be swung laterally relative to the plate section 22 to move the glove finger 33 laterally toward or away from the glove finger 34 as shown by the two phantom line illustrations in FIG. 3. In this way, the glove finger 34 may be placed over the little finger 19 and then the glove finger 33 may be adjusted laterally as necessary to fit the width of the hand and to overlie the index finger 18. In order to secure the glove in its laterally adjusted position, the head 67 (FIG. 7) of a screw 68 is sandwiched between the forward plate section 22 and the foam pad 25 and is secured to the forward plate section. The shank 69 of the screw projects through a circular hole in the forward plate section 22 and through a laterally elongated and slightly curved slot 70 (FIGS. 3 and 7) formed in the rear plate section 21. A knurled cap nut 71 is threaded onto the screw shank 69 and, when tightened, clamps the two plate sections 21 and 22 together to hold the glove 15 securely in its laterally adjusted position. When the nut 71 is loosened, the elongated slot 70 permits relative swinging of the plate sections about the pivot 65.

When the glove 15 is manufactured, the glove fingers 33 and 34 are made longer than the index and little fingers 18 and 19 of most hands. When the glove is sold, the glove fingers may be trimmed to a length suited to the individual bowler by cutting the end portions of the glove fingers away with shears or a knife along lines as indicated, for example, by the dotted lines 75 in FIG. 2.

Figure 2:
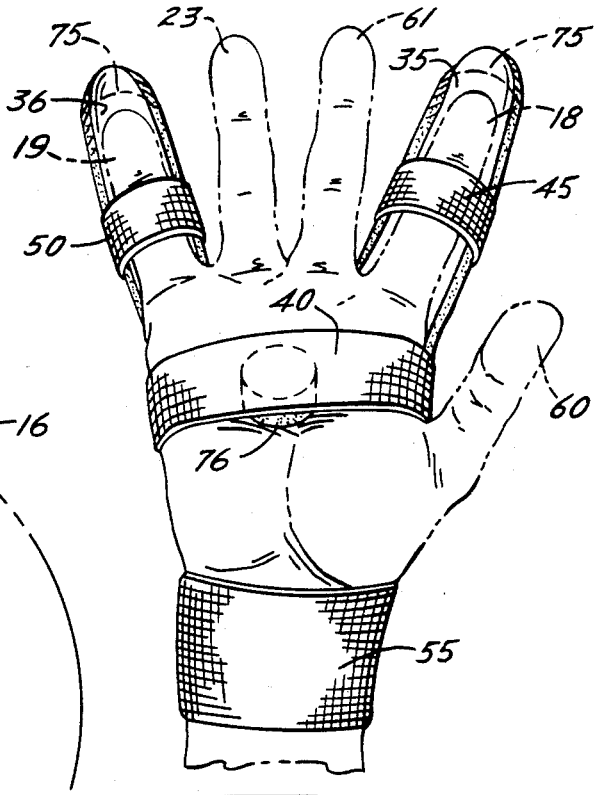
FIG. 2 is a front elevational view showing the glove secured to a hand by straps.
Figure 4:
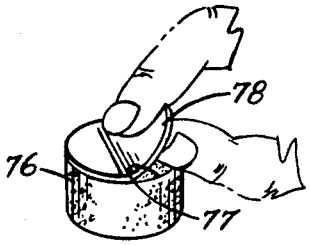
FIG. 4 is a perspective view of a cushioning button which may be optionally used with the glove.

In some cases, the bowler may prefer additional cushioning or spacing between the strap 40 and the palm of the hand 17. For these purposes, the glove 15 is accompanied by a cylindrical foam rubber button 76 (FIGS. 2 and 4) having one end with pressure-sensitive adhesive 77 which originally is protected by a peel-away backing 78. If the bowler desires to use the button 76, the backing 78 may be removed and the button may be adhered to the inside of the strap 40 so as to lie between the strap and the palm of the hand as shown in FIG. 2.

I claim:

1. A bowling glove for a person's hand and comprising a substantially rigid plate adapted to overlie the back of the hand opposite the palm thereof, laterally spaced and substantially rigid fingers projecting downwardly from said plate and adapted to overlie the back of the index finger and the back of the little finger of the hand, the space between said rigid fingers being open to permit the other two fingers of the hand to be placed between said rigid fingers, and means for securing said glove tightly but releasably to the hand.

2. A bowling glove as defined in claim 1 further including a substantially rigid tongue projecting upwardly from said plate and adapted to overlie the back of the wrist.

3. A bowling glove as defined in claim 2 in which said tongue is formed integrally with said plate.

4. A bowling glove as defined in claim 3 in which one of said rigid fingers is formed integrally with said plate.

5. A bowling glove as defined in claim 1 in which said plate is formed by two separate sections, one of said rigid fingers projecting downwardly from one of said sections and the other of said rigid fingers projecting downwardly from the other of said sections, means connecting said sections to each other to enable said sections to be laterally adjusted relative to one another and thereby enable the lateral spacing between said rigid fingers to be adjusted, and means for releasably fastening said sections against lateral adjustment relative to each other.

6. A bowling glove as defined in claim 5 in which said connecting means comprises a pivot extending between the two sections of said plate and extending substantially perpendicular to the plate to permit relative lateral swinging of the two sections.

7. A bowling glove as defined in claim 6 in which a portion of one of said sections of said plate overlies a portion of the other section, a laterally extending slot formed in the overlying section and located downwardly from said pivot, said fastening means comprising a screw having a head larger than said slot and having a shank extending through said slot.

8. A bowling glove as defined in claim 1 in which said plate and said rigid fingers are made of substantially rigid plastic, and soft cushioning material secured to the forward side of said plate and to the forward sides of said rigid fingers.

9. A bowling glove as defined in claim 8 in which said soft cushioning material comprises an elastomeric material bonded to said plate and said fingers.

10. A bowling glove as defined in claim 1 in which said securing means comprise first, second and third straps each having first and second Velcro-type ends, said first strap being adapted to be wrapped around the palm of the hand and having one end secured permanently to the back side of said plate, said second and third straps being adapted to be wrapped around the index finger and the little finger, respectively, of the hand, said second strap having one end secured permanently to the back side of one of said rigid fingers, and said third strap having one end secured permanently to the back side of the other rigid finger.

11. A bowling glove as defined in claim 10 further including a button of elastomeric material, and means for releasably securing said button to said first strap at a position causing the button to be located between said first strap and the palm of the hand.

12. A bowling glove as defined in claim 1 in which said rigid fingers are angled downwardly and forwardly from said plate.

13. A bowling glove for a person's hand and comprising a substantially rigid plate adapted to overlie the back of the hand opposite the palm thereof, a substantially rigid tongue projecting upwardly from said plate and adapted to overlie the back of the wrist, laterally spaced and substantially rigid fingers projecting downwardly from said plate and adapted to overlie the back of the index digit and the back of the little digit of the hand, the space between said rigid fingers being open to permit the other two finger digits of the hand to be placed between said rigid fingers, and means for tightly but releasably strapping said plate to said hand, said tongue to said wrist and said rigid fingers to said index and little digits.

14. A bowling glove as defined in claim 13 in which said plate is formed by two separate sections, one of said rigid fingers projecting downwardly from one of said sections and the other of said rigid fingers projecting downwardly from the other of said sections, means connecting said sections to each other to enable said sections to be laterally adjusted relative to one another and thereby enable the lateral spacing between said rigid fingers to be adjusted, and means for releasably fastening said sections against lateral adjustment relative to each other.

15. A bowling glove as defined in claim 13 in which the forward sides of said plate, said tongue and said rigid fingers are curved to conform generally to the curvature of the back of the hand, the back of the wrist and the backs of the index and little fingers.

16. A bowling glove for a person's hand and comprising a plate adapted to overlie the back of the hand opposite the palm thereof, said plate being formed by two overlapping sections made of substantially rigid material, a tongue formed integrally with and projecting upwardly from one of said sections and adapted to overlie the back of the wrist, a finger formed integrally with and projecting downwardly from said one section and adapted to overlie the back of one of the index digit and little digit of the hand, a laterally spaced finger formed integrally with and projecting downwardly from the other section of said plate and adapted to overlie the back of the other of the index digit and little digit of the hand, the space between said fingers being open to permit the other two finger digits of the hand to be placed between said fingers, means connecting said sections to each other to enable said sections to be adjusted laterally relative to one another and thereby enable the lateral spacing between said fingers to be adjusted, means for releasably fastening said sections against lateral adjustment relative to each other, and means for tightly but releasably strapping said plate to said hand, said tongue to said wrist and said fingers to said index and little digits.

17. A bowling glove as defined in claim 16 in which said connecting means comprises a pivot extending between the two sections of said plate and extending substantially perpendicular to the plate to permit relative lateral swinging of the two sections.

18. A bowling glove as defined in claim 17 in which a portion of one of said sections of said plate overlies a portion of the other section, a laterally extending slot formed in the overlying section and located downwardly from said pivot, said fastening means comprising a screw having a head larger than said slot and having a shank extending through said slot.

19. A bowling glove as defined in claim 18 in which said plate, said tongue and said fingers are made of substantially rigid plastic, and elastomeric cushioning material bonded to the forward sides of said plate, said tongue and said fingers.

20. A bowling glove as defined in claim 19 in which the forward sides of said plate, said tongue and said fingers are curved to conform generally to the curvature of the back of the hand, the back of the wrist and the backs of the index and little fingers.

* * * * *